US007204344B2

(12) United States Patent
Korchagin et al.

(10) Patent No.: US 7,204,344 B2
(45) Date of Patent: Apr. 17, 2007

(54) HIGH-RISE, FIRE-FIGHTING, RESCUE AND CONSTRUCTION EQUIPMENT

(75) Inventors: Pavel V. Korchagin, Apt. 81, House 30, Building 1, Beskudnikovsky Boulevard, Moscow, Russia (RU) 127474; Marina E. Korchagina, Apt. 112, House 5, Second Khoroshevskiy Lane, Moscow, Russia (RU) 123007; Igor I. Goldstein, 16776-39th Ave. N., Plymouth, MN (US) 55446

(73) Assignees: Pavel V. Korchagin, Moscow (RU); Marina E. Korchagina, Moscow (RU); Igor I. Goldstein, Moscow (RU); Andrey G. Tirskiy, Moscow (RU)

( * ) Notice: Subject to any disclaimer, the term of this patent is extended or adjusted under 35 U.S.C. 154(b) by 45 days.

(21) Appl. No.: 10/431,946

(22) Filed: May 8, 2003

(65) Prior Publication Data

US 2004/0262086 A1 Dec. 30, 2004

Related U.S. Application Data

(63) Continuation-in-part of application No. 10/334,023, filed on Dec. 30, 2002, now Pat. No. 7,036,630, which is a continuation-in-part of application No. 10/205,981, filed on Jul. 26, 2002, now Pat. No. 7,096,996.

(51) Int. Cl.
*B66B 9/00* (2006.01)
*E04G 3/00* (2006.01)

(52) U.S. Cl. ..... 182/82; 182/37; 187/239

(58) Field of Classification Search ..... 182/82, 182/37, 142; 187/239; 104/127
See application file for complete search history.

(56) References Cited

U.S. PATENT DOCUMENTS

| | | | | |
|---|---|---|---|---|
| 394,781 | A * | 12/1888 | Maurer | 182/229 |
| 4,018,306 | A * | 4/1977 | Lyons | 182/148 |
| 4,023,503 | A * | 5/1977 | Grop | 105/30 |
| 4,121,689 | A * | 10/1978 | Bonvin | 182/3 |
| 4,830,141 | A * | 5/1989 | Montaigne | 182/82 |
| 4,865,155 | A * | 9/1989 | Montaigne et al. | 182/14 |
| 5,533,670 | A * | 7/1996 | Chen | 238/187 |

FOREIGN PATENT DOCUMENTS

DE 3939762 A1 * 6/1991

* cited by examiner

*Primary Examiner*—Alvin Chin-Shue
(74) *Attorney, Agent, or Firm*—Steven E. Kahm; Nikolai & Mersereau, P.A.

(57) ABSTRACT

An elevator system for traveling on a rail attached to the outside of a high-rise building. One elevator having a telescoping arm attached for reaching any position on or above the building. A platform or cabin attached to the telescoping arm can deliver materials to the building while under construction and thereafter be used for building maintenance such as window washing. The movable platform adjacent a building can take the place of scaffolding for a safer work environment. The telescoping arm may have various attachments for different functions such as for rescuing people trapped in a high-rise during a fire or for positioning fire fighters and hoses or fire fighting equipment next to a fire. The elevators may be raised and lowered by motors connected to cables or under their own power.

12 Claims, 17 Drawing Sheets connecting cross bar
First Plate
Second Plate

1st side
2nd side
106
107
131
Building
4th wheel guide channel
3rd wheel guide channel
110
4th wall
1st wheel guide channel
2nd wheel guide channel
1st wall
2nd wall
104
108
3rd wall
wheel engaging and aligning portion
109
103
105
gap
wheel axle support

HIGH-RISE, FIRE-FIGHTING, RESCUE AND CONSTRUCTION EQUIPMENT

This application is a continuation-in-part of Ser. No. 10/334,023 filed Dec. 30, 2002 now U.S. Pat. No. 7,036,630, which is a continuation-in-part of Ser. No. 10/205,981 filed Jul. 26, 2002 now U.S. Pat. No. 7,096,996.

BACKGROUND OF THE INVENTION

1. Field of the Invention

This invention relates generally to a combination elevator and crane system running on a rail attached to the outside of a building. The elevator system may have two cars, a combination elevator and crane and an elevator. The invention can be used for fire fighting and rescue and can also be used for construction and maintenance of high-rise structures. Different rail systems and rail engaging systems can be used. The elevator portion can be powered and drive themselves up and down the rails or cables can be used to lift and lower the elevators. A rail section can be installed on the building with the elevator on the rail section and connected to the other rail sections or the elevator can be installed on the rail by pivoting arms. Elevator portion can be permanently attached to the building rail or transported to the building.

2. Description of the Related Art

Currently vertical transportation in high-rise structures is limited to stairs and elevators. Fire fighters on the outside of the building are limited by how high their ladders will reach when fighting fires or attempting rescues. Construction and building maintenance is limited as to access to the outside walls and roof of the building. For example window washing is limited to a plank precariously dangling from ropes extending from the top of a building. Construction of the building is similarly hampered by the need for scaffolding and lack of easy transportation and access to all areas on the outside of the high-rise building.

SUMMARY OF THE INVENTION

The invention utilizes an elevator having a crane portion. The elevator portion is for traveling vertically up and down the outside of a building. The crane portion extends form the elevator portion to a desired location on the building. The crane portion can support a passenger cabin for fire rescue. The cabin can also have fire-fighting equipment for access to all portions of a building. The crane can also haul building materials to any location on a building under construction and can be used for window washing or other maintenance activities on the outside of the building.

The crane portion has a telescoping arm for adjusting the distance between the cabin and the elevator. The telescoping arm has pivots on both ends. One pivot is attached to the cabin for keeping the floor of the cabin horizontal. The second pivot is to angularly position the telescoping arm relative the elevator portion. A rotating portion on the elevator portion swings the telescoping arm toward or away from the building.

The invention can also utilize a second elevator. Both elevators run vertically on an H shaped rail attached to the side of a building. The rail has a channel for running two separate cables connected to two separate trolleys riding in the channel for lifting and lowering the elevators on the rail. The rail is engaged by wheels on the elevators to stabilize the elevator. The wheels can be mounted on arms that pivot and temporarily clamp the elevator to the rail permitting the elevator to engage the rail or the elevator wheels can permanently engage the rail. The pivoting arms can be opened to remove the elevator from the rail so that the elevator can be transported to a different rail on the same building or to a rail on another building. Alternatively the elevator can be permanently fixed to the H rail and run along it with gear wheels engaging apertures in the rail. The elevator is attached to the building on a section of rail added to the existing rail on the building to extend the rail and attach the elevator to the building.

OBJECTS OF THE INVENTION

It is an object of the invention to provide vertical and horizontal transportation to the outside surface or roof of a building.

It is an object of the invention to transport fire-fighting equipment at any point on the outside of a building.

It is an object of the invention to rescue people from buildings during fires or other emergencies.

It is an object of the invention to transport construction materials to any part of a building under construction.

It is an object of the invention to provide a platform for construction or maintenance personnel for working on a building.

It is an object of the invention to provide a transportable fire fighting and rescue system to high-rise structures.

It is an object of the invention to quickly and easily attach the elevator to the rail on the outside of a building.

It is an object of the invention to add a rail section to the building rail system with the elevator on the added rail section to quickly install the elevator on the building.

Other objects, advantages and novel features of the present invention will become apparent from the following description of the preferred embodiments when considered in conjunction with the accompanying drawings.

DESCRIPTION OF THE PREFERRED EMBODIMENTS

High-rise buildings are hazardous during fires since fire-fighting equipment is limited to reaching only the lower floors because ladders, cherry pickers and other equipment have limits of extension well short of the upper floors. A further hazard is that inside elevators cannot be used during a fire since people could become trapped inside the elevators or be exposed to smoke. It therefore becomes difficult to evacuate a high-rise building during a fire, to rescue people trapped inside or to fight the fire.

Further, it is useful to have equipment on the building for access to the outside surface for window washing and maintenance. The equipment can also be used during construction to haul materials and workmen to the positions on the outside of the building or to access the upper floors and roof during construction.

Figure 1:
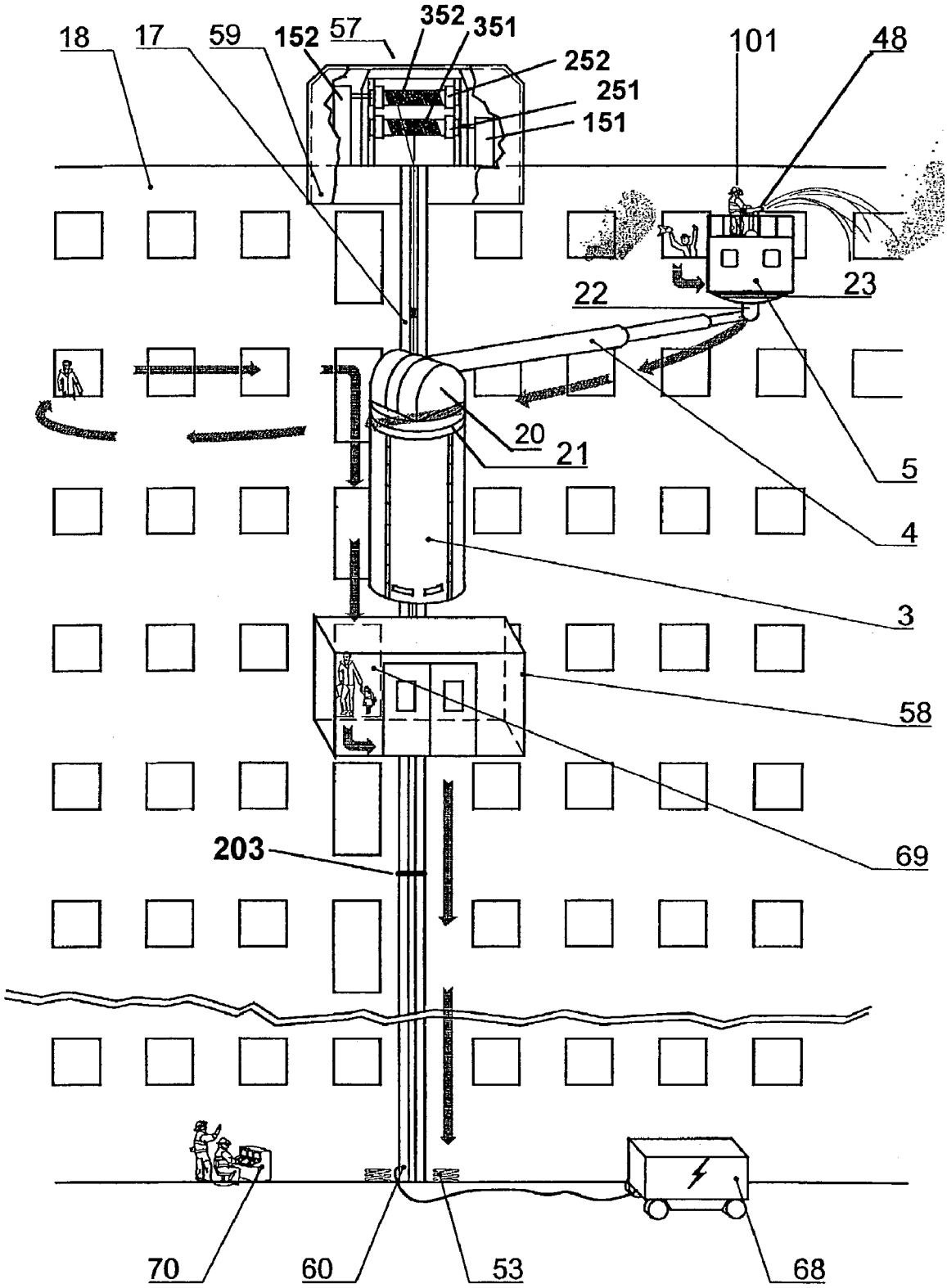
FIG. 1 shows a front view of the invention on a building.

As shown in FIG. 1 the invention provides a vertical column or rail 17 attached to the outside surface of a building 18 and an elevator car or elevator cars 3 and 58 attached to the rail 17 for riding up and down the outside of the building 18.

Building 18 has a housing 59 on the roof containing lifting mechanism 57, which comprises motors 151 and 152 for driving two separate spools 251 and 252 respectively, having two separate cables 351 and 352 respectively, for lifting or lowering the elevator cars 3 or 58.

Elevator 58 is stored in housing 59 until it is needed. It is aligned with emergency exits 69 on the outside of building 18 for evacuating people during emergencies such as a fire.

Shock absorbing elements such as springs 53 at the base of column 17 help provide a smooth stop for elevator car 58 at the base of building 18.

An auxiliary power supply 68 can be used to supply power to the motors 151 and 152 to power the elevators 3 and 58 in case of a power outage in the building 18. The power supply 68 plugs into the column 17 at electrical connector 60.

The controls for elevators 3 and 58 can be in the elevators or remotely controlled from ground at control station 70.

Elevator 3 has a crane portion attached on the top. The crane portion comprises a pivoting mechanism 20, a turning mechanism 21, a telescoping arm 4, a pivoting mechanism 22, and a cabin 5, a cabin with a platform or just a platform. The cabin or platform 5 can support fire fighting equipment 48 and firemen 101. The cabin 5 can be rotated on turning mechanism 23. The crane portion can position the cabin 5 at any desired position along the face of the building 18 by a combination of the elevator 3 moving up or down, and the crane portion using the pivoting mechanism 20 to swing the telescoping arm 4 to the desired angle and then extending or retracting to a desired position adjacent building 18. The turning mechanism 21 can move the cabin 5 toward or away from the building 18. The turning mechanism 23 can rotate the cabin 5 to align doors on the cabin with the building or to align fire-fighting equipment with the building. The cabin 5 can be used to rescue people who cannot get to the emergency exits 69.

The vertical column 17 can be attached to a building 18 as the building is being constructed or it can be added to an existing building. The vertical column 17 can have expansion joints 203 between sections of rail 17. The expansion joints 203 can be made out of an alloy or material which is fireproof and has a low coefficient of expansion with temperature.

Figure 2:
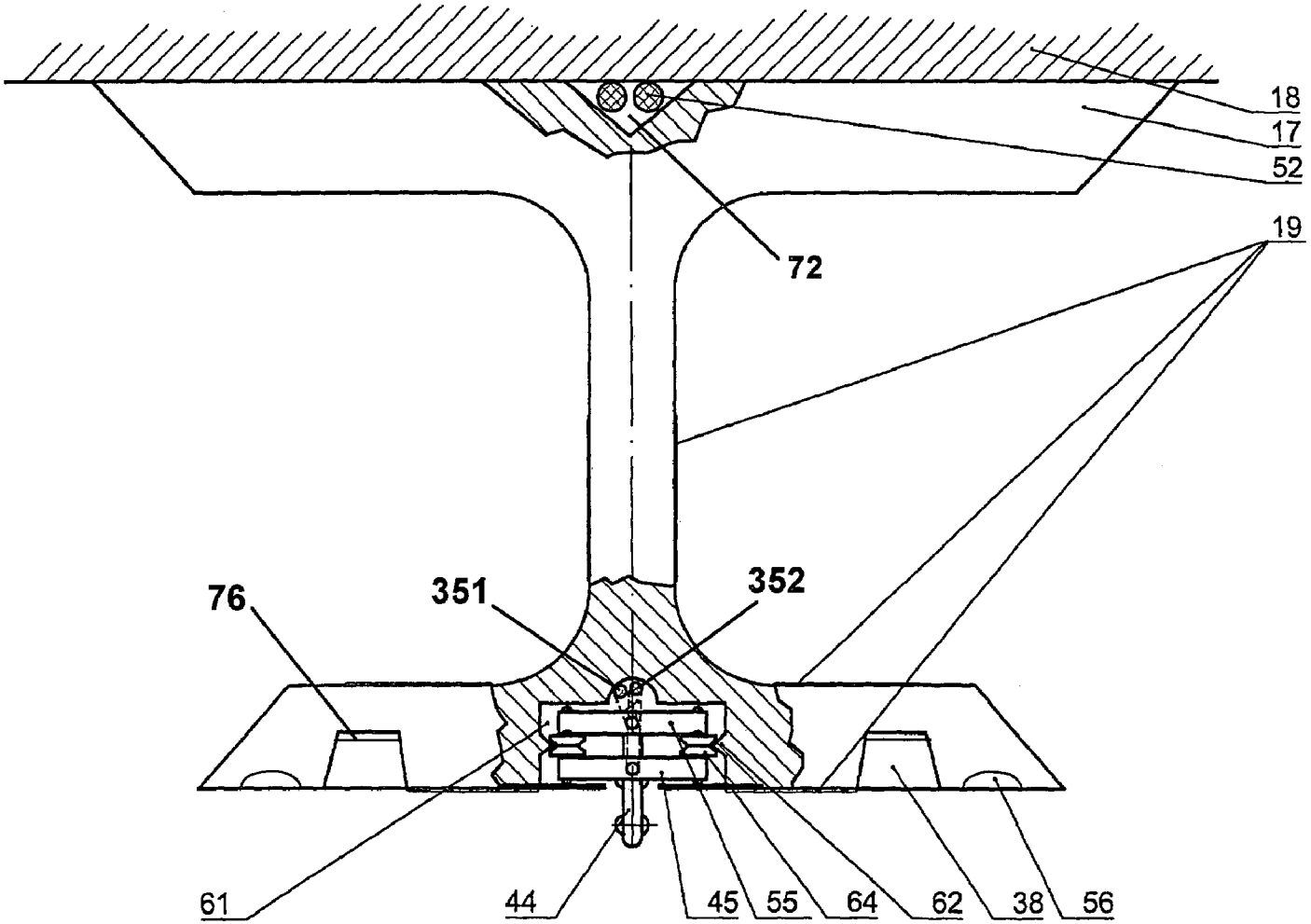
FIG. 2 shows a top cross section of the elevator column.

As FIG. 2 shows, vertical column or rail 17 has an H shape and has several features designed for use with elevators 3, 58. The vertical column 17 has a high friction coating 19 to make a better contact with tires 9 on the elevators 3 and 58. A power cable channel 72 in the H shaped vertical column 17 allows electrical power cables 52 to access the roof to drive motors 151 and 152. Guides 38 on the outside face of vertical column 17 allow for wheels 9 or cog wheels 36 on the elevators 3 and 58 to engage the teeth 76 on vertical column 17 and keep the elevators 3, 58 aligned on the column 17. Lights 56 may also be installed on the vertical column 17 to help during nighttime operations.

The H shaped vertical column 17 also has a trolley channel 61 for cables 351 and 352 to travel in. The cables 351 and 352 are connected to trolleys 45 and 55, which run separately in trolley channel 61. Trolley 45 is attached to elevator car 3 and trolley 55 is attached to elevator car 58. Trolley wheels 64 engage the trolley guides 62 in the trolley channel 61.

Figure 3:
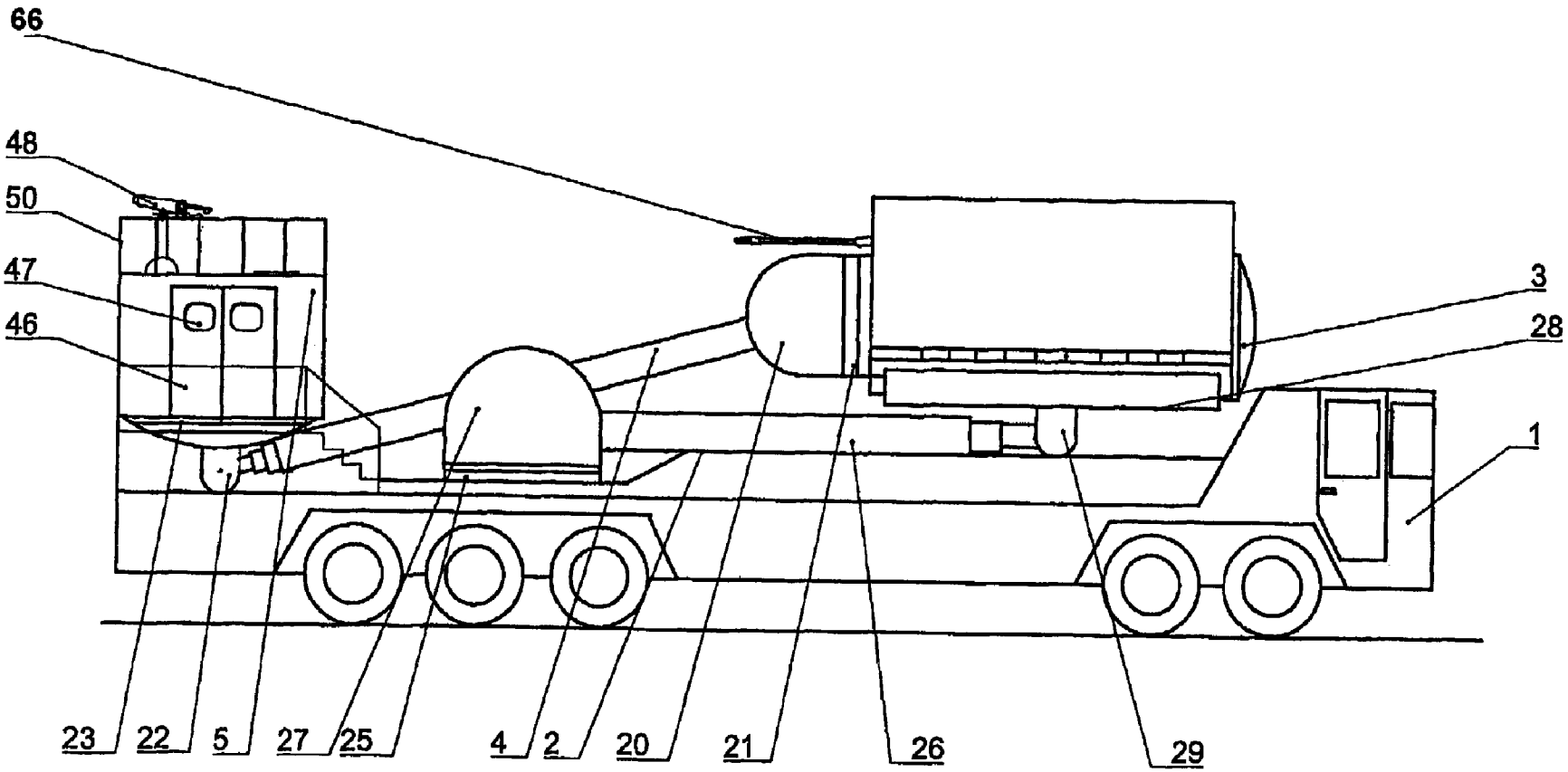
FIG. 3 shows a side view of the elevator with crane on a transport vehicle.

As shown in FIG. 3 the elevator 3 and the crane portion are transportable to building 18 by a truck 1. If the elevator 3 is for fire fighting the truck 1 may be a specialized fire truck. If the elevator is used during construction or maintenance the truck may be a construction truck. When truck 1 arrives at building 18 the elevator 3 is attached to the rail 17. When finished with its work, elevator 3 can be removed from the rail 17 and used on another portion of the same building or moved to a different building.

Figure 4:
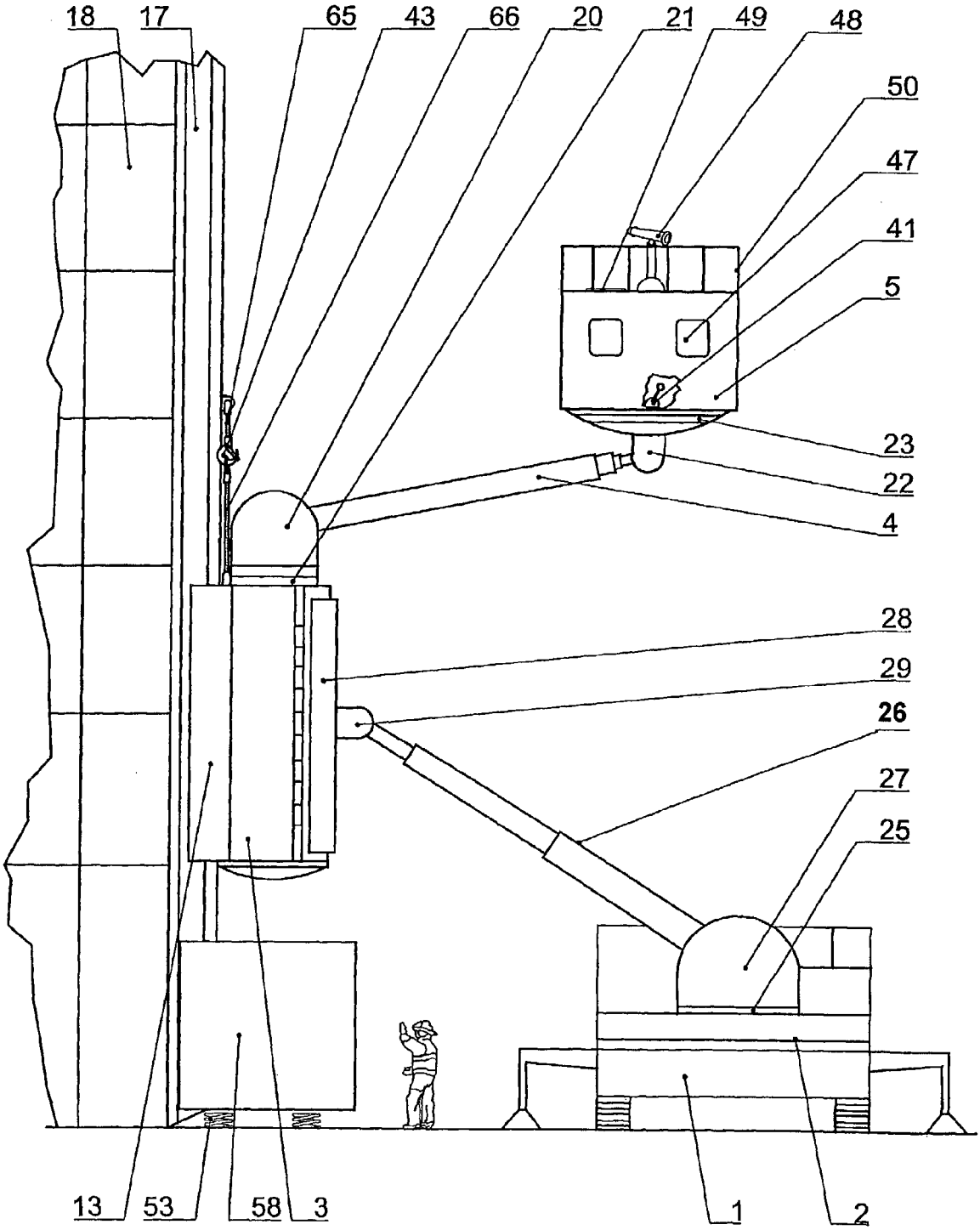
FIG. 4 shows a side view of the elevator with crane being installed on a rail.

FIG. 4 shows elevator 3 being installed on vertical column 17. Truck 1 is adjacent the building 18. The top surface 2 of the truck 1 has a rotating mechanism 25 for turning pivoting mechanism 27 which has a telescoping arm 26 attached. Telescoping arm 26 is connected to pivoting mechanism 29, which is connected to holding mechanism 28 for holding elevator 3 in position for connecting it to vertical column 17.

Figure 9:
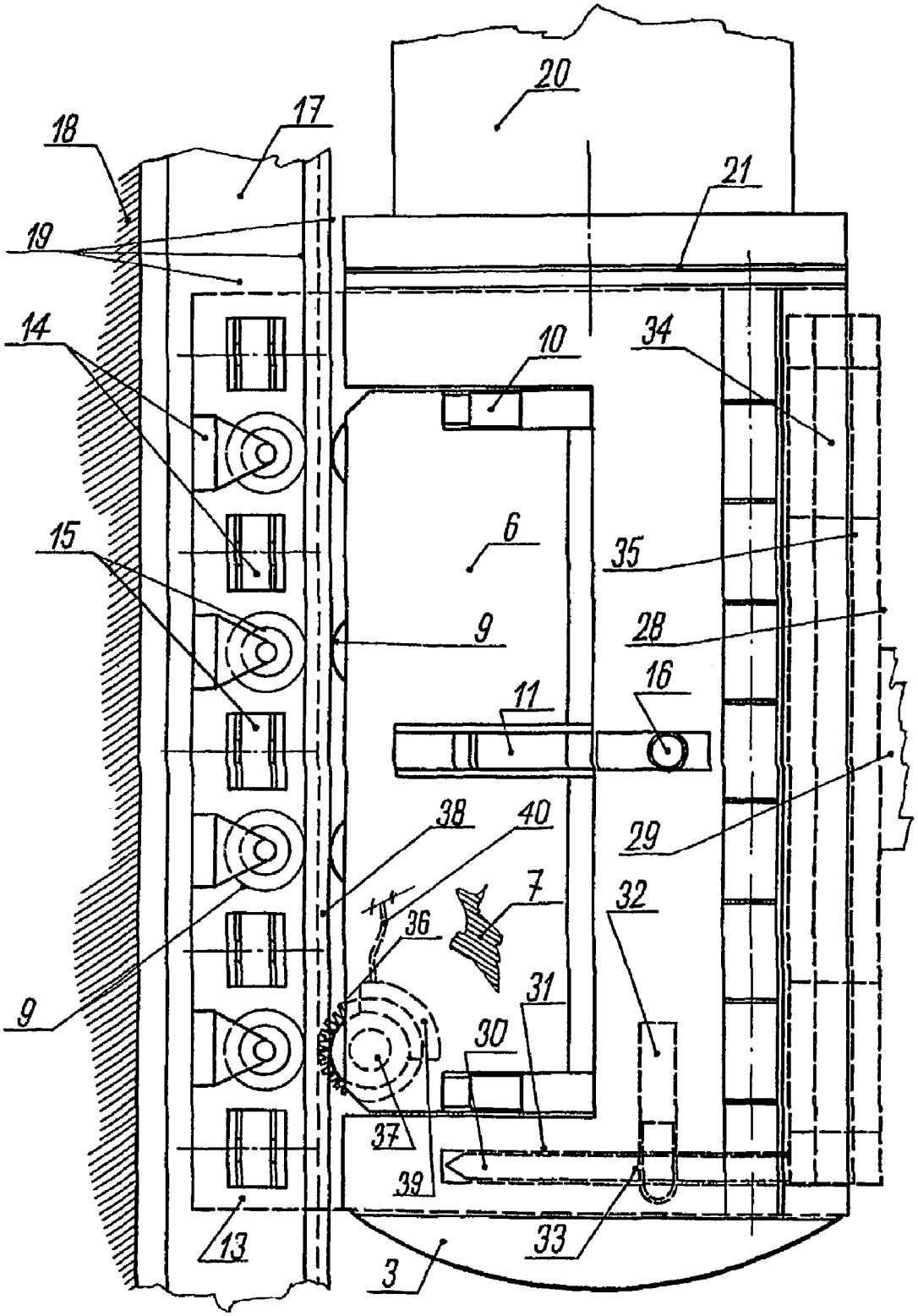
FIG. 9 is a side cross sectional view of the elevator with crane on the rail.
Figure 10:
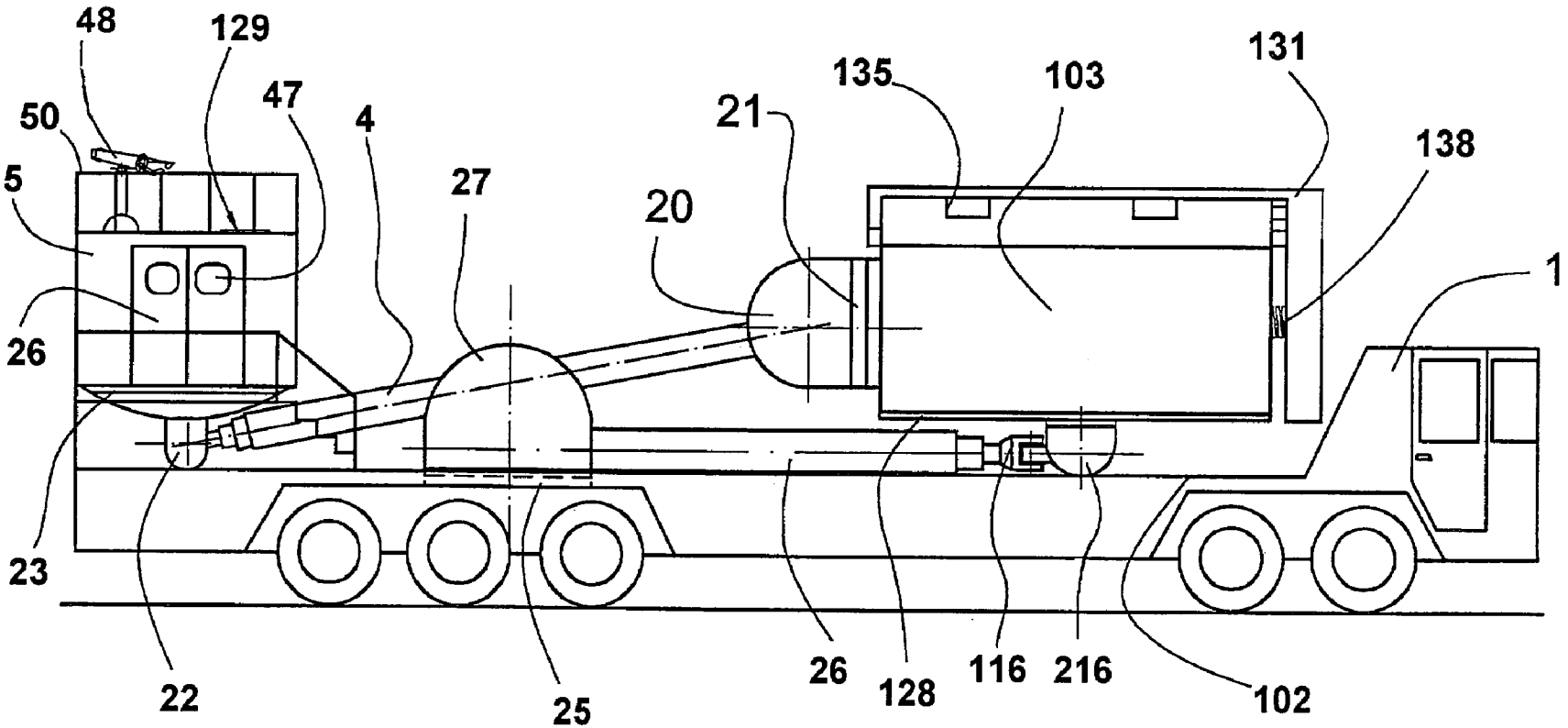
FIG. 10 shows a side view of the elevator with crane and rail section on a transport vehicle.
Figure 11:
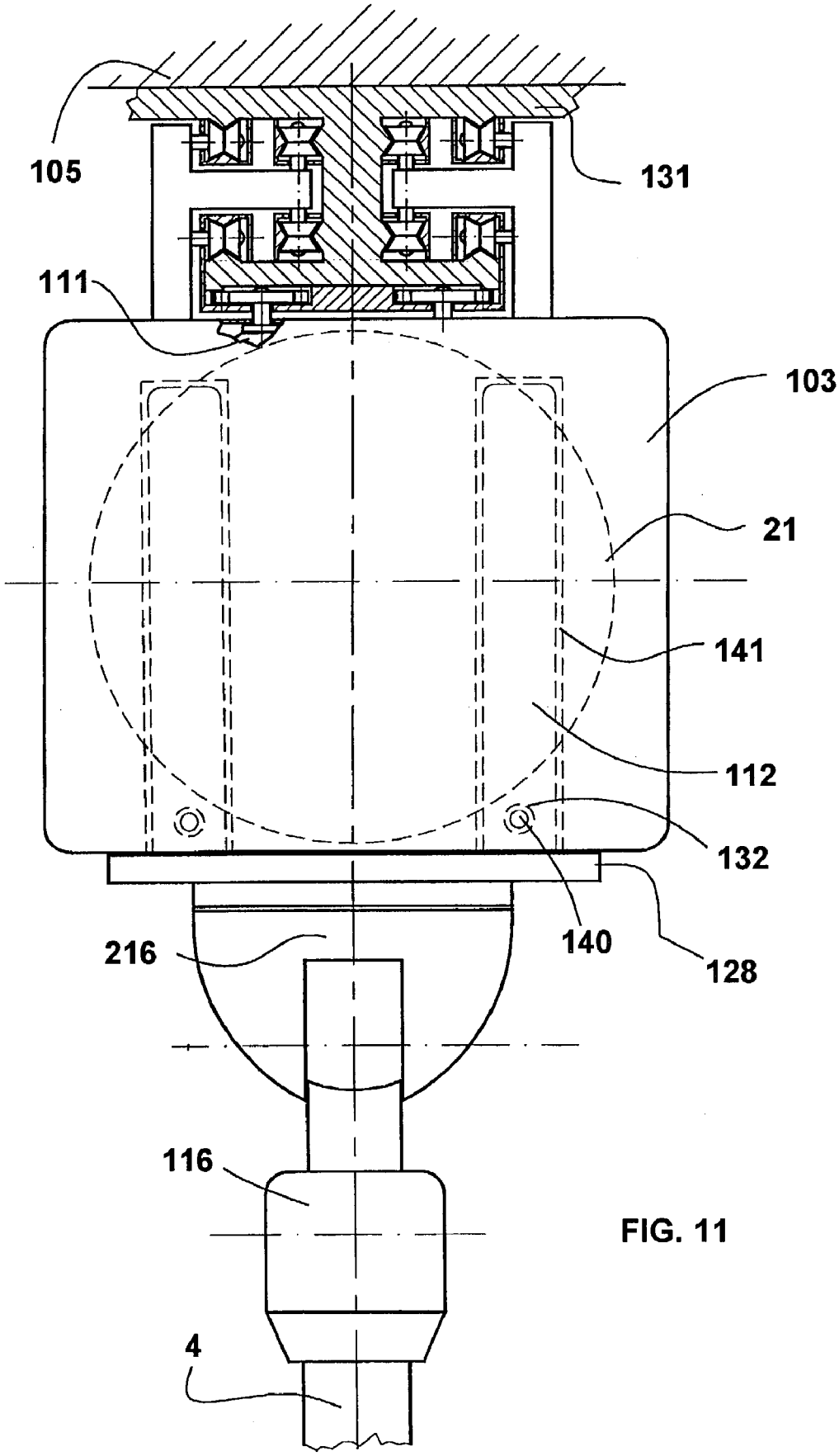
FIG. 11 is a top view of the elevator with crane and rail section being attached to a building.

FIG. 9 shows how the elevator 3 is lifted into place by holding mechanism 28. Forklift tines 30 are inserted into a portion of the elevator 3. The forklift tines 30 have apertures 33 which are engaged by jack elements 32 to lock the elevator 3 onto the forklift tines 30 while the elevator 3 is being positioned against rail 17. A stabilizing slot 35 on elevator 3 helps hold the elevator 3 in position on holding mechanism 28, which fits into the slot. Optionally electromagnets 34 can be used to either hold the elevator 3 in position relative to the holding mechanism 28 or act in conjunction with the fork tines 30 to hold the elevator 3 in place.

Figure 5:
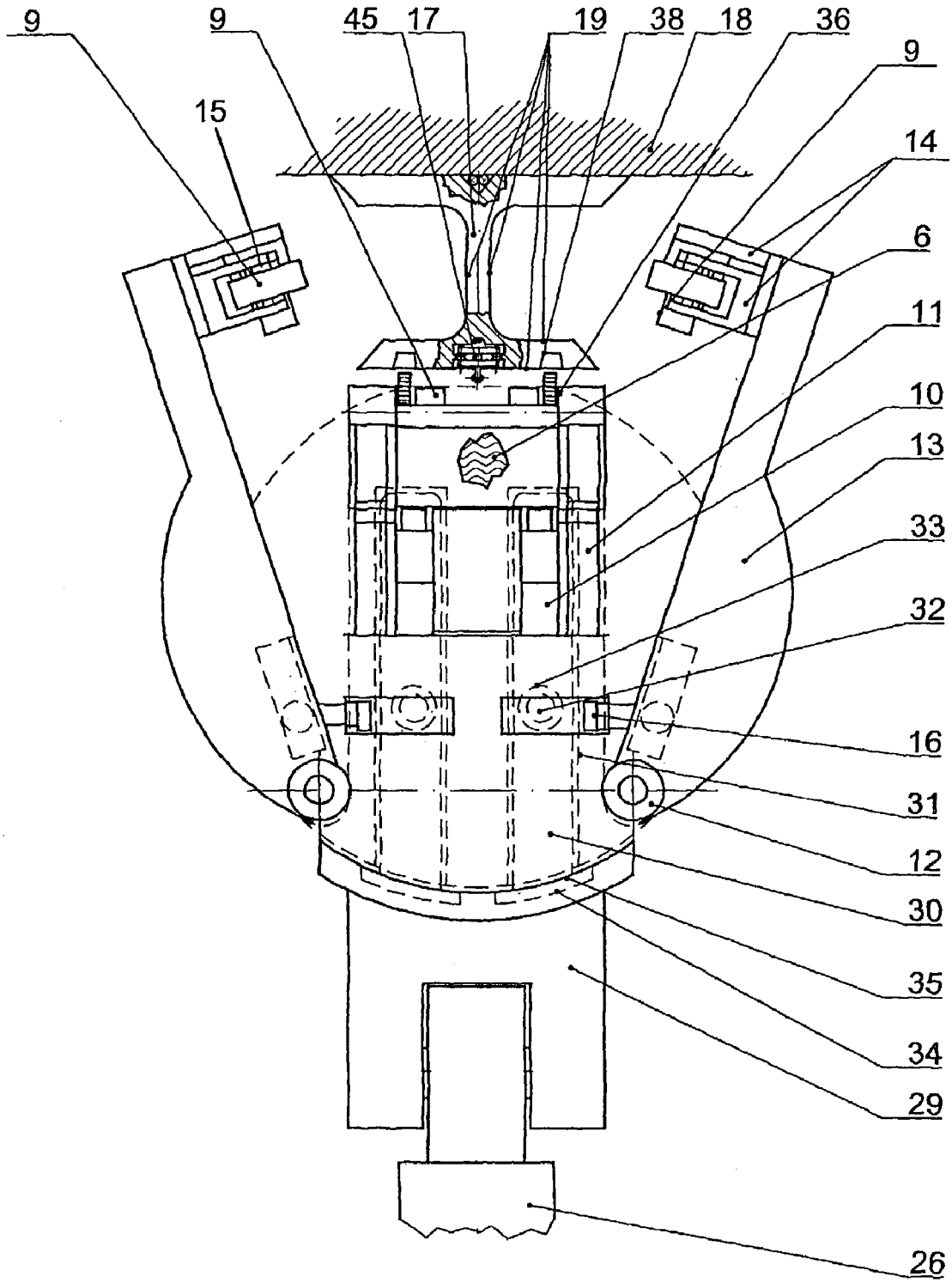
FIG. 5 shows a top view of the elevator with the arms open and wheels disengaged from the rail.
Figure 6:
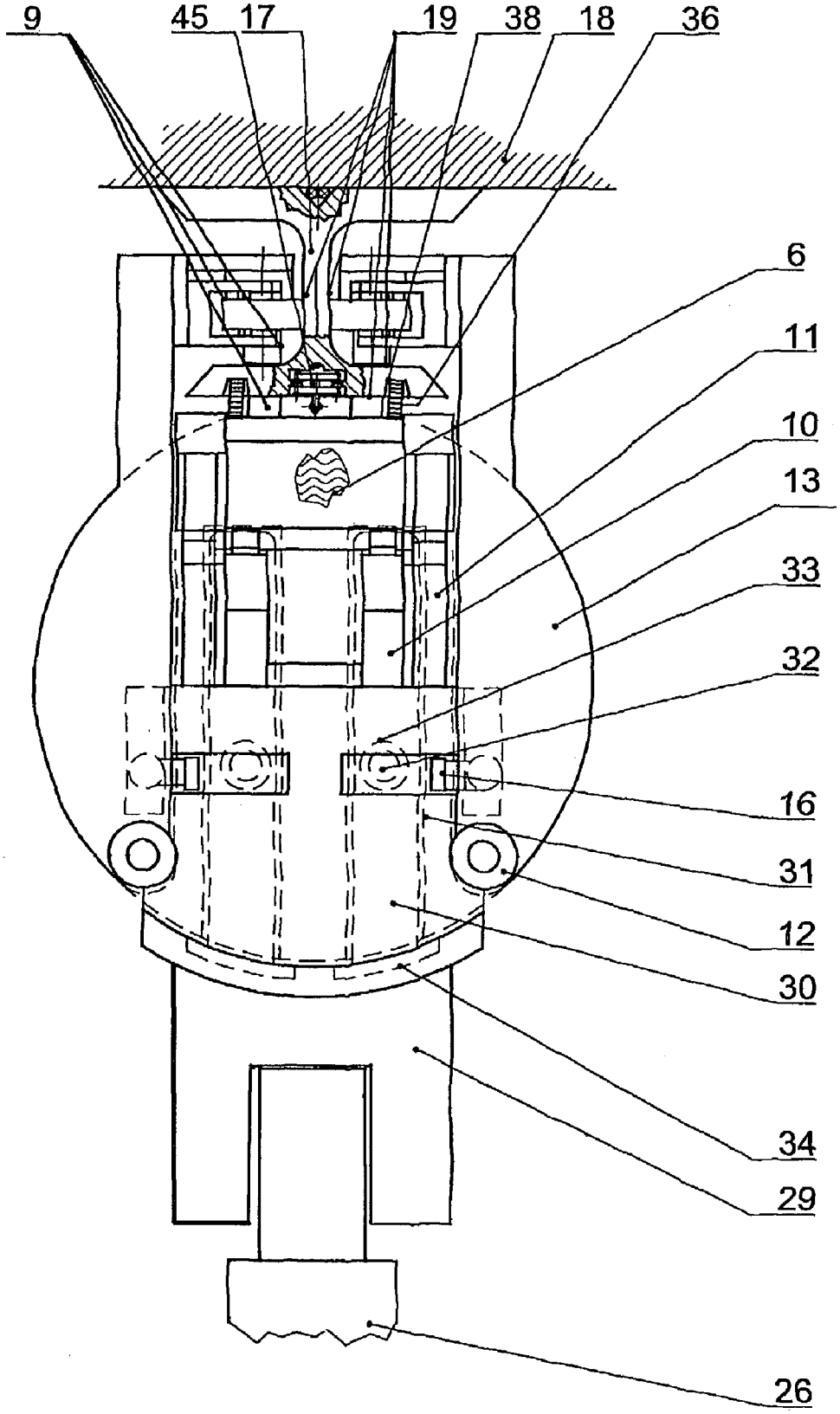
FIG. 6 shows a top view of the elevator with the arms closed and wheels engaging the rail.
Figure 7:
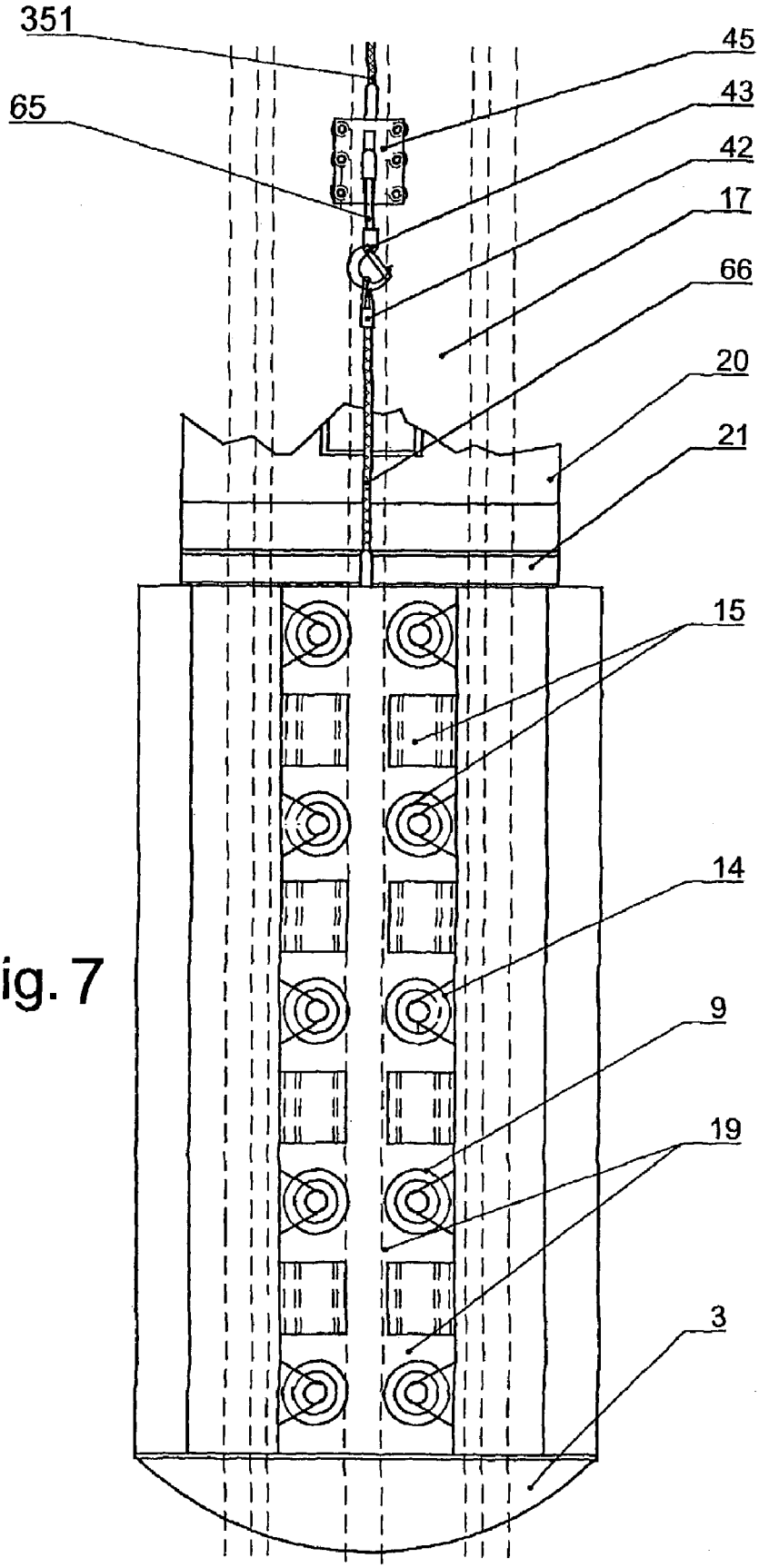
FIG. 7 is a front cross sectional view of an elevator connected to a trolley.

As shown in FIGS. 5, 6 and 7 the H shaped column 17 is engaged by elastic tires 9 on wheels 15, to prevent left to right movement on the rail 17 relative to the building 18. The wheels 15 are supported on frames 14 attached to spreadable arms 13. The arms 13 pivot on hinge 12 and are opened or closed by operating pistons 16. When arms 13 are opened the elevator portion 3 can be removed from the H shaped rail 17. When the arms 13 are clamped closed on the H shaped rail 17 the elevator portion 3 is attached to the rail 17.

With the elevator portion 3 attached to the rail 17 additional wheels 15 having tires 9 on the spread arms 13 rotated 90 degrees to the first set of wheels 15 have tires 9 to engage the inside surface of the top of the H shaped rail 17. Additional wheels 15 with tires 9 engage the outside surface of the top of the H shaped rail 17. The wheels 15 on the inside and outside of the top of the H shaped rail 17 are pressed together by a jack device 11 engaging telescoping beam 10 to push tires 9 against rail 17

Guides 38 indented in the columns 17 engage wheels such as cogwheels 36, which engage apertures in the columns 17 to grippingly engage the column 17. A brake having break calipers 39 operating on disc 37 attached to cog wheel 36 (FIG. 9) can be used by operating brake lever 41 attached to brake cable 40 for stopping the elevator 3 in emergencies by pulling on break lever 41 in cabin 5 on elevator 3 or in elevator 58.

With elevator 3 held in place on column 17 it can be connected to trolley 45 by a cable 66 having an eye connector 42 on the end of the cable and placed on hook 43, which is attached by a cable 65 to the trolley 45.

Figure 8:
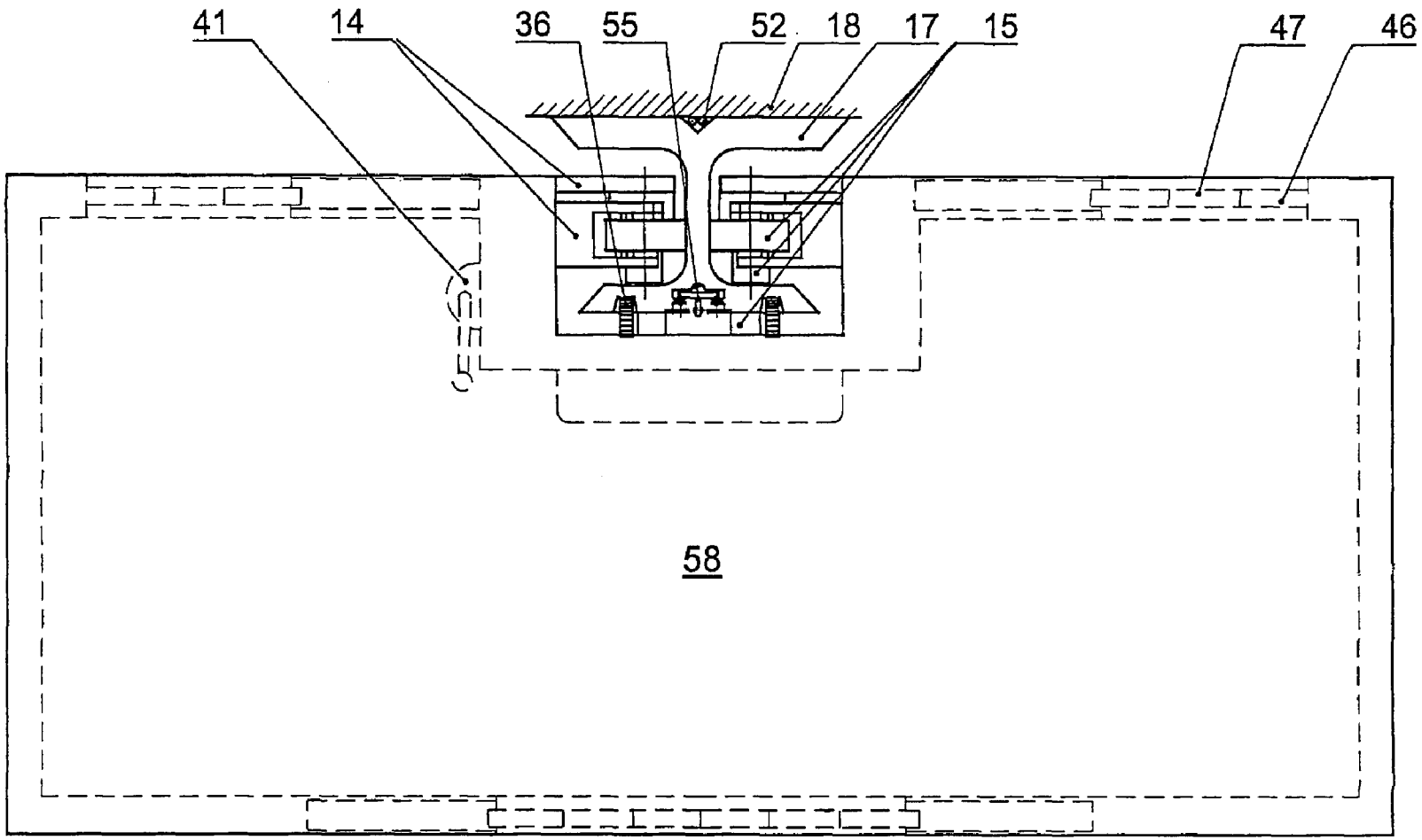
FIG. 8 shows a top cross sectional view of an elevator on the H shaped rail.

Elevator 58 as shown in FIG. 8 is attached to column 17 in a similar manner as elevator 3, the difference being that elevator 58 is permanently connected to the column 17. Therefore wheel frame 14 is permanently in place for holding the tires 9 on wheels 15 against column 17.

In some embodiments the cogwheels 36 can be used as the drive wheels. An engine compartment 7, in FIG. 9, has an engine or electric motor for providing power to drive wheels 36 for propelling the elevator portion 3 along column 17. In this embodiment the cables 351 and 352, the trolleys 45, 55, the trolley channel 61 and the housing 59 with its associated motors 151, 152 and spools 251, 251 are not needed.

In both the embodiments the elevator 58 or cabin 3 can carry passengers. The elevators can have fireproof doors 46 and fireproof windows 47 and walls.

Elevator 58 can be directly connected to trolley 55 without intervening cables since it is permanently connected to rail 17.

Cabin 5 has an access hatch 49 for climbing out of the cabin 5 to the top of the cabin, which has a flat roof for standing on and a railing 50. Fire fighting equipment 48 such as a nozzle can be used to spray water, foam or chemicals on a fire. A hatch 129 in the roof of cabin 5 provides for movement from the inside to the outside of the cabin.

In an alternative embodiment as shown in FIGS. 10–17 the arms 13 for attaching the elevator to the rail 17 and the associated telescoping beams 10, hinges 12 and operation pistons 16 can be eliminated thus reducing weight and the complexity of the system. The motors 151, 152, cables 351, 352 and housing 59 on the roof containing lifting mechanism 57 and associated elements can be eliminated and replaced with a direct drive from the elevator 3 or elevators 3 and 58.

When the elevator crane 103 is needed at a building 105 in an emergency such as a fire, or for other uses, a truck 100 having a bed 102 with a pivoting mechanism 27 and rotating mechanism 25 attached arrives at the building 105 near rail 104 to attach a removable rail section 131 and elevator 103 to the building 105 under an existing rail 104. The pivoting mechanism 27 and rotating mechanism 25, raises and turns telescoping arm 26 which extends to move the holding mechanism 128 toward building 105. The pivoting mechanism 116 and rotating mechanism 216 tilt the holding mechanism 14 to an upright position for attaching the removable rail section 131 to building 105 directly beneath rail 104.

Figure 15:
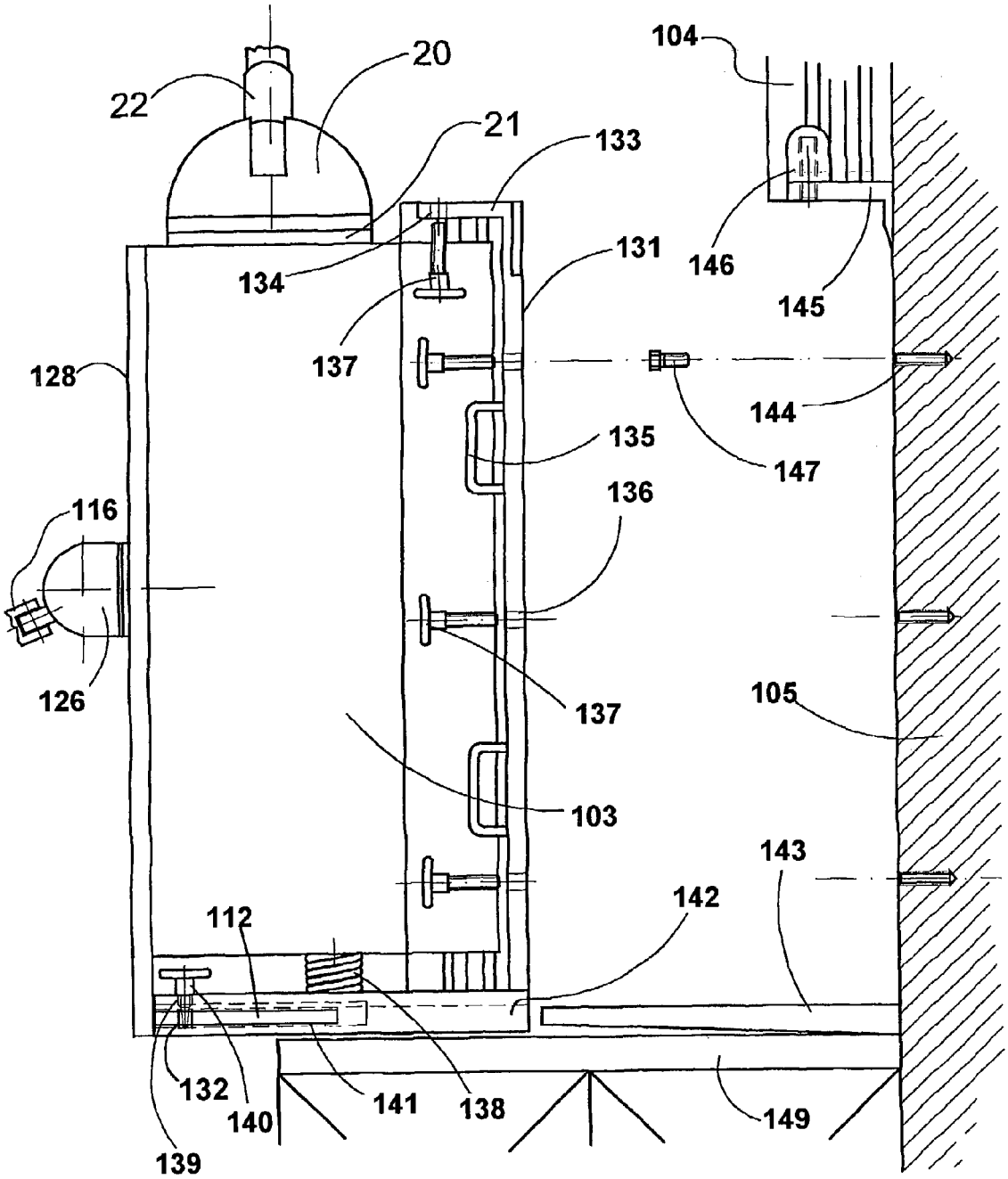
FIG. 15 is side view of the elevator on the attachment section being installed on a building.
Figure 16:
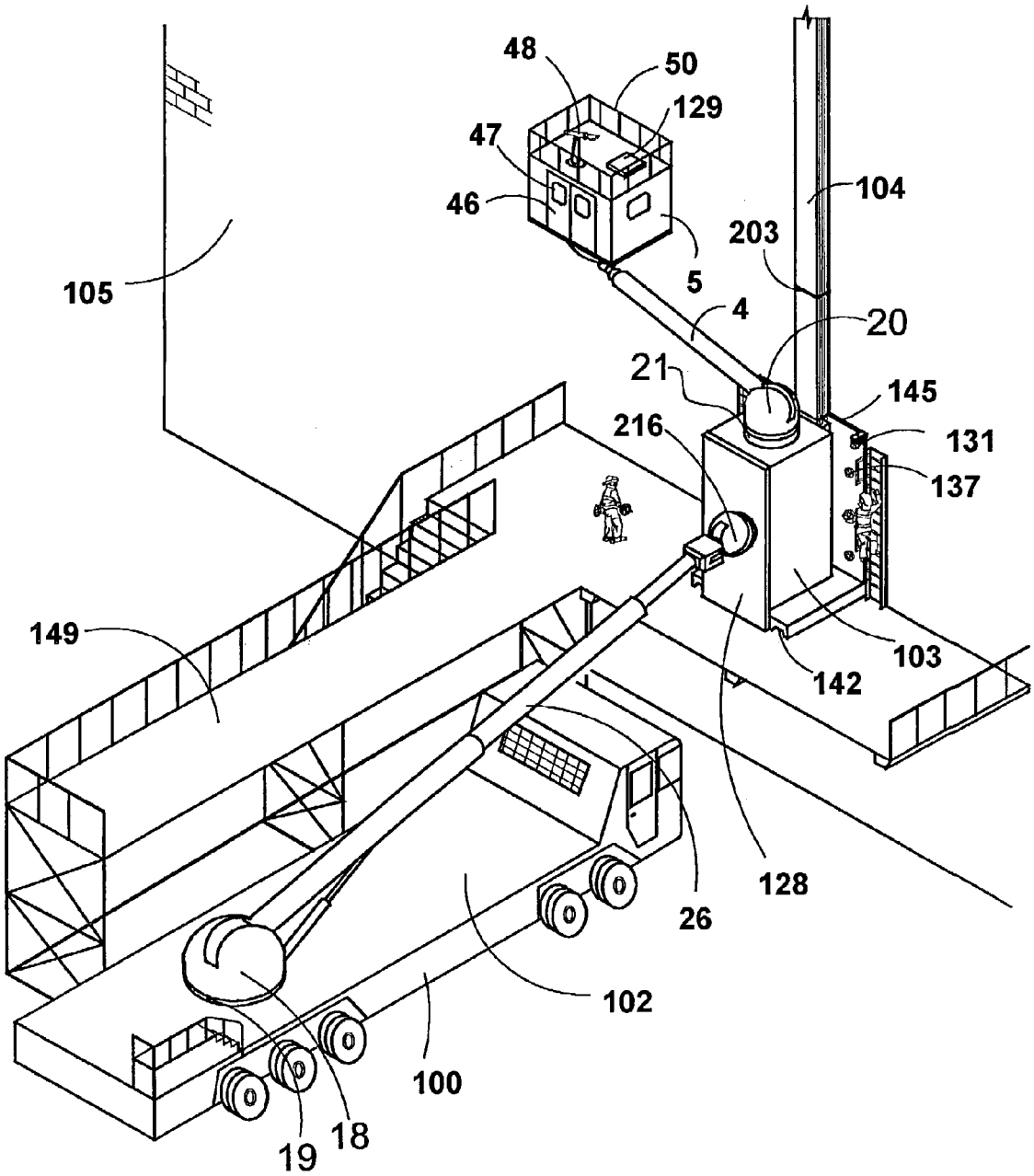
FIG. 16 is a perspective view of the transport vehicle installing the elevator and attachment section to a building.
Figure 17:
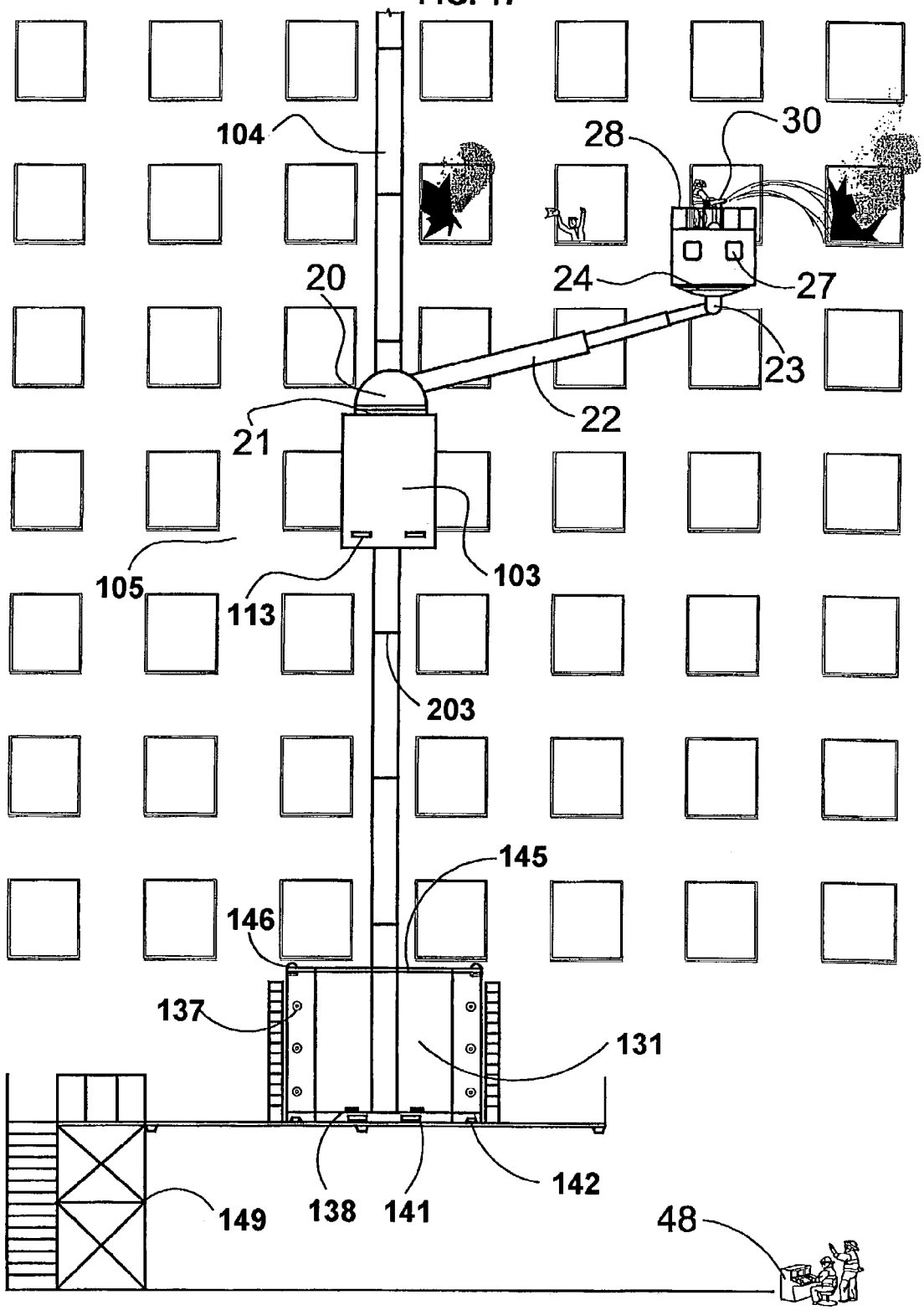
FIG. 17 is a front view of a building having the elevator and crane system used for fire fighting and rescue.

As best seen in FIG. 15 building 105 has rail 104 attached which does not extend all the way to the ground. Removable rail section 131 is placed against the building 105 by sliding the slit guides 142 onto fork elements 143 on building 105. The removable rail section 131 will be guided into place against the building 105 and the holding mechanism 128 can then be detached from the elevator 103 by removing screw holders 140 from the tapped hole 139 in the slit guide 141 and aperture 132 in fork element 112 on holder 128. The fork element 112 can then be withdrawn by telescoping arm 4 and the removable rail section 131 can be maneuvered by handles 135 such that the apertures 136 match up with bolt holes 144 in building 105 and screws 137 are inserted to secure the removable rail section 131 to building 105. Screw caps 147 may be installed on building 105 to plug the boltholes 144 and protect them when the removable rail section 131 is not attached to the building. If the screw caps 147 are installed they must be removed before screws 137 are installed.

Spring dampers 138 are mounted on removable rail section 131 to provide safety conditions during installation and removal.

A screw 137 is also used to secure angular element 133 to rail guide 145 by use of threaded element 146 to align and properly space the removable rail section 131 with respect to rail 104 on building 105. The alignment is important to provide toothed carriage rails 109 with the proper spacing for the driving gear wheels 108 at the interface of the removable rail section 131 and the toothed carriage rails 109 in rail 104 permanently attached to building 105. The gear wheels 108 are connected to motor 111 to provide power to the elevator 103. The gear wheels 108 may also have breaks to stop the elevator 103.

Figure 12:
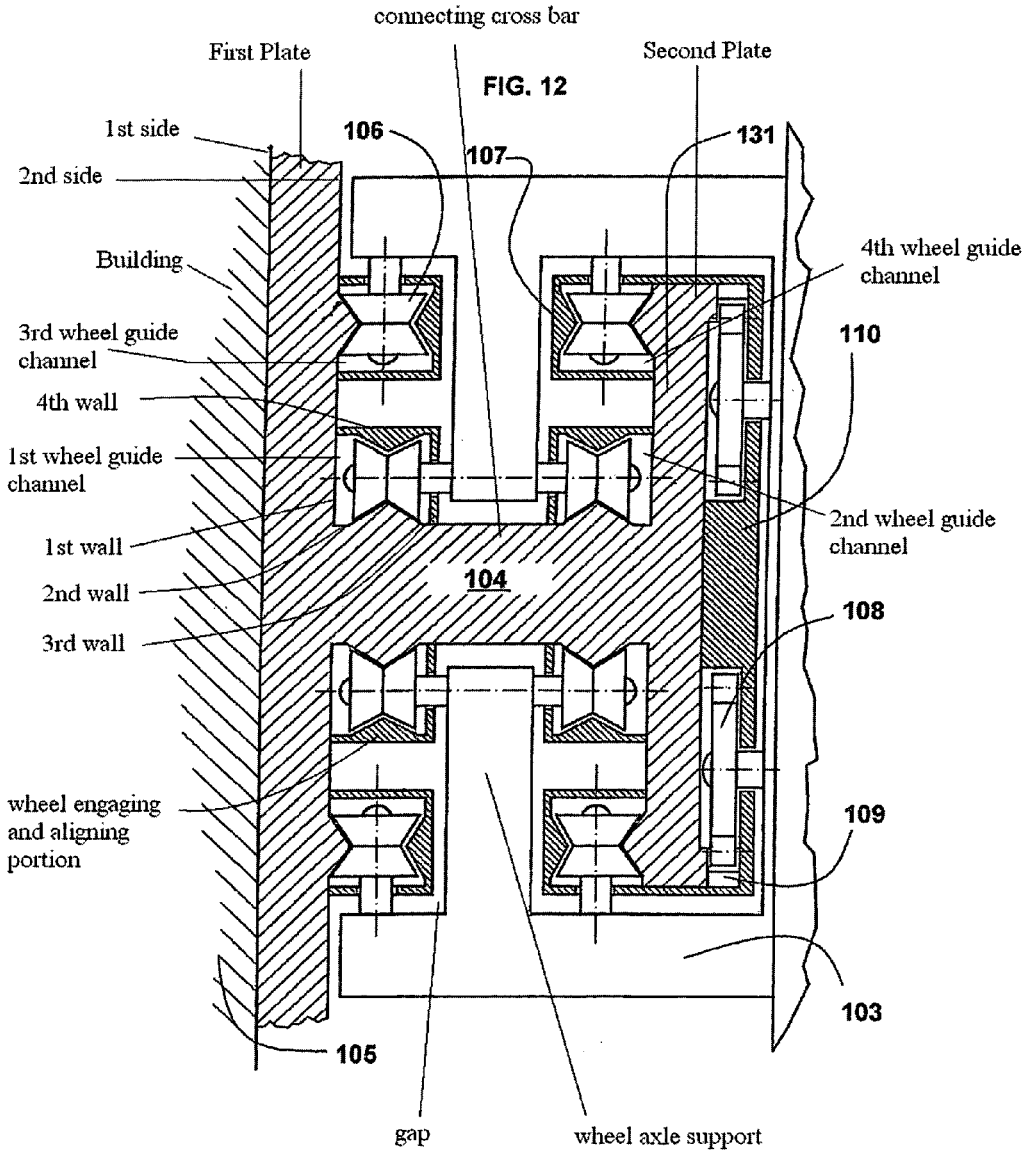
FIG. 12 is a top view of the elevator wheels and gear wheels on a rail.
Figure 13:
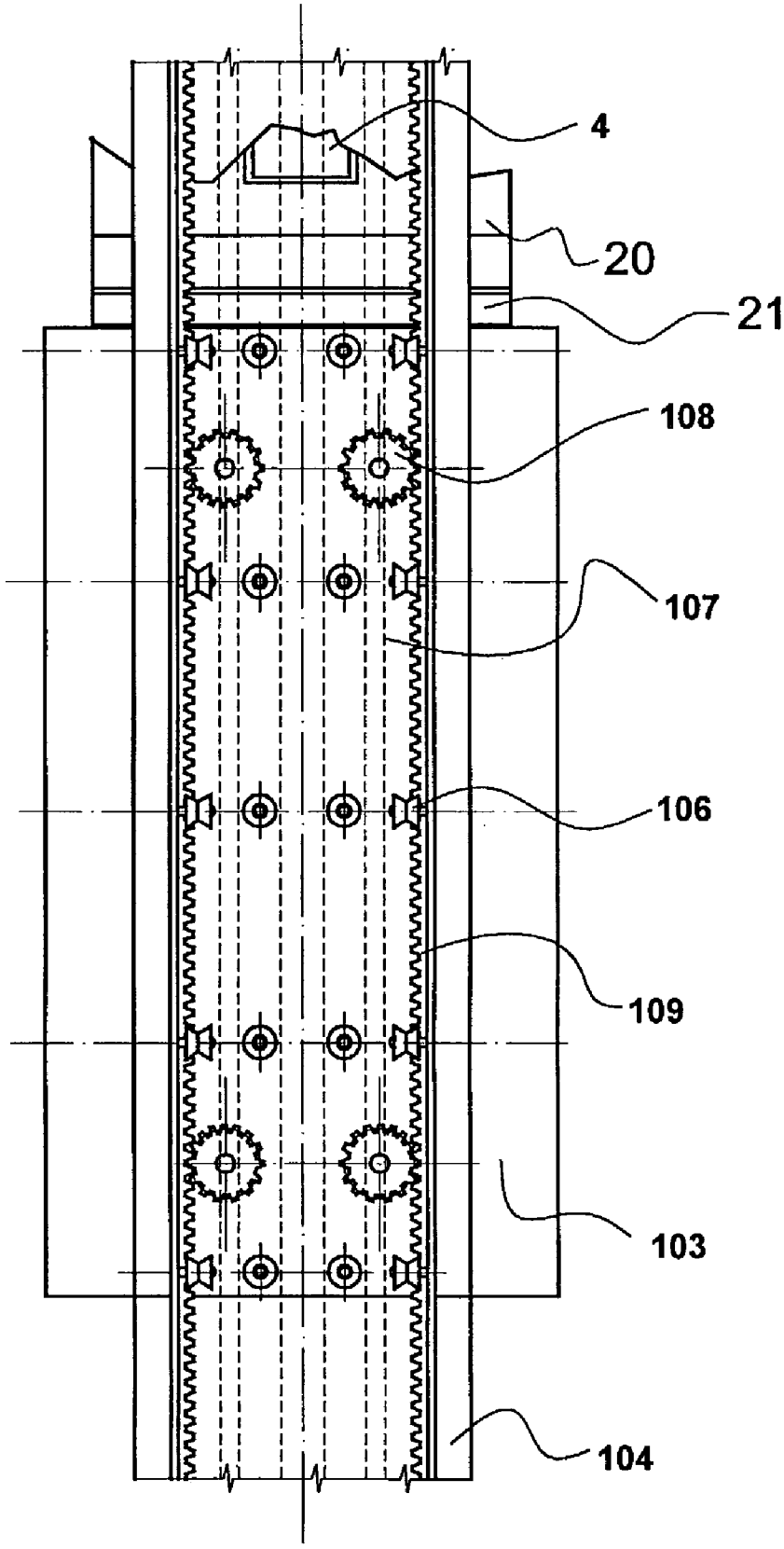
FIG. 13 is a side view of the elevator wheels and gear wheels on a rail.
Figure 14:
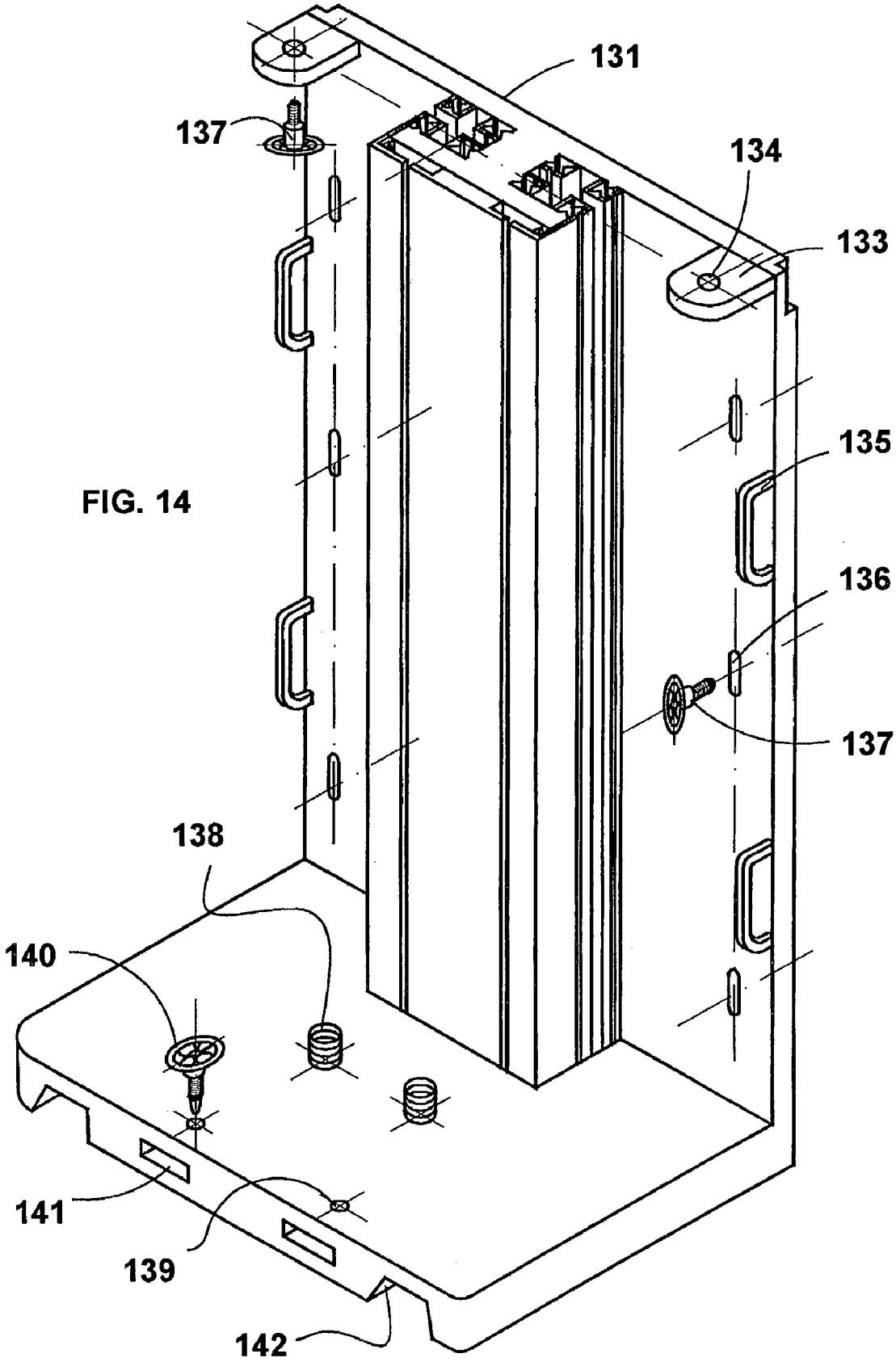
FIG. 14 is a perspective view of the rail attachment section.

As shown in FIG. 12 elevator 103 has wheels 106 which ride on slit guides 107 in rail 104. The sets of wheels 106 are placed perpendicular to each other to provide prevent the elevator from wobbling in two dimensions on rail 104.

Instead of the removable rail section 131 being attached to building 105 at ground level a platform 149 may be used to provide access to the position of attachment of the rail section 131 above the ground. Such an arrangement may be useful to guarantee access to the base of the rail 104 due to snow, parked cars, or other obstructions on the ground.

Obviously, many modifications and variations of the present invention are possible in light of the above teachings. It is therefore to be understood that, within the scope of the appended claims, the invention may be practiced otherwise than as specifically described.

What is claimed is:

1. An elevator rail for attachment to the outside of a building comprising:

a first plate having a first face and a second face opposite the first face, the first plate attached to the side of a building with the first face adjacent to the side of a building, a second plate having a first face and a second face opposite the first face, a connecting cross bar perpendicular to the second side of the first plate and to the first side of the second plate, separating the first plate and the second plate and forming an H shape, the first plate attached to the outside of a building with the first face of the first plate facing the building, the connecting cross bar having a right face and a left face, a first wheel guide channel having, a first wall along the first plate second side, a second wall along the right face of the cross bar, with a wheel engaging and aligning portion thereon, a third wall attached perpendicularly to the first plate second side with a wheel engaging and aligning portion thereon, and a fourth wall parallel to the first wall to complete the channel, the fourth wall having a gap for a wheel axle to pass through, a second wheel guide channel having, a first wall along the second plate first side, a second wall along the right face of the cross bar, with a wheel engaging and aligning portion thereon, a third wall attached perpendicularly to the first plate second side with a wheel engaging portion and aligning thereon, and a fourth wall parallel to the first wall to complete the channel, the fourth wall having a gap for a wheel axle to pass through, a third wheel guide channel having, a first wall along the first plate second side, with a wheel engaging portion thereon, a second wall, attached to the first wall, parallel to the right face of the cross bar, a third wall, with a wheel engaging portion thereon, attached perpendicularly to second wall, and a fourth wall parallel to the cross bar to complete the channel, the fourth wall, parallel to and distal from the cross bar having a gap for a wheel axle to pass through, a forth wheel guide channel having, a first wall along the second plate first side, with a wheel engaging portion thereon, a second wall, attached to the first wall, parallel to the right face of the cross bar, a third wall, attached perpendicularly to second wall, with a wheel engaging portion thereon, and a fourth wall parallel to, and distal from, the right face of the cross bar to complete the channel, the fourth wall having a gap for a wheel axle to pass through, a gap between the channels on the first wall and the channels on the second wall, to allow room for a wheel axle support arm to travel between the channels, and with a mirror image of four more wheel guide channels on the left face of the cross bar.

2. An elevator rail for attachment to the outside of a building as in claim 1 having, a rack with teeth attached to the second plate second side for engaging a cogwheel on an elevator to propel the elevator on the rail.

3. An elevator rail for attachment to the outside of a building as in claim 2 having, a rack wall parallel to the second plate for sandwiching the rack between the second plate and the rack wall.

4. An elevator rail for attachment to the outside of a building as in claim 3 having, a gap in the rack wall for the cogwheel axle.

5. An elevator rail for attachment to the outside of a building as in claim 1 having, a base attached to the bottom of the rail, for holding an elevator thereon while the elevator is engaging the rail.

6. An elevator rail for attachment to the outside of a building as in claim 2 having, a base attached to the bottom of the rail, for holding an elevator thereon while the elevator is engaging the rail.

7. An elevator rail for attachment to the outside of a building as in claim 5 having, a pair of fork lift slots in the base for transporting the base and rail to a building.

8. An elevator rail for attachment to the outside of a building as in claim 6 having, a pair of fork lift slots in the base for transporting the base and rail to a building.

9. An elevator rail for attachment to the outside of a building as in claim 5 having, a spring on the top of the base to engage an elevator.

10. An elevator rail for attachment to the outside of a building as in claim 6 having, a spring on the top of the base to engage an elevator.

11. An elevator rail for attachment to the outside of a building as in claim 5 having, an extended width first wall with bolt apertures for attaching the rail to a building wall.

12. An elevator rail for attachment to the outside of a building as in claim 6 having, an extended width first wall with bolt apertures for attaching the rail to a building wall.

* * * * *